US012319322B2

(12) United States Patent
Zhao et al.

(10) Patent No.: US 12,319,322 B2
(45) Date of Patent: Jun. 3, 2025

(54) BOGIE FRAMEWORK OF RAIL VEHICLE AND BOGIE

(71) Applicant: CRRC QINGDAO SIFANG CO., LTD., Qingdao (CN)

(72) Inventors: Wei Zhao, Qingdao (CN); Yuejun Zhang, Qingdao (CN); Haitao Hu, Qingdao (CN); Shaoshuai Liu, Qingdao (CN); Shuliang Song, Qingdao (CN)

(73) Assignee: CRRC QINGDAO SIFANG CO., LTD., Qingdao (CN)

( * ) Notice: Subject to any disclaimer, the term of this patent is extended or adjusted under 35 U.S.C. 154(b) by 842 days.

(21) Appl. No.: 17/609,364

(22) PCT Filed: May 18, 2020

(86) PCT No.: PCT/CN2020/090828
§ 371 (c)(1),
(2) Date: Nov. 5, 2021

(87) PCT Pub. No.: WO2020/238678
PCT Pub. Date: Dec. 3, 2020

(65) Prior Publication Data

US 2022/0212696 A1 Jul. 7, 2022

(30) Foreign Application Priority Data

May 30, 2019 (CN) ..... 201910462853.X

(51) Int. Cl.
*B61C 9/50* (2006.01)
*B61B 13/04* (2006.01)
(Continued)

(52) U.S. Cl.
CPC ..... *B61C 9/50* (2013.01); *B61B 13/04* (2013.01); *B61C 9/38* (2013.01); *B61F 5/52* (2013.01); *B61C 9/52* (2013.01)

(58) Field of Classification Search
CPC ..... B61F 5/52; B61C 9/38; B61C 9/48; B61C 9/50; B61B 13/04
See application file for complete search history.

(56) References Cited

U.S. PATENT DOCUMENTS 3,513,782 A * 5/1970 Lich ..... B61F 3/04 105/139
10,167,002 B2 * 1/2019 Chen ..... B61C 9/48
2022/0212697 A1 * 7/2022 Song ..... B61C 9/50

FOREIGN PATENT DOCUMENTS

CN 104442880 A 3/2015
CN 105197047 A 12/2015
(Continued)

OTHER PUBLICATIONS

The First Office Action for Chinese Application No. 201910462853.X mailed Dec. 30, 2019, 12 pages, [English Translation].
(Continued)

*Primary Examiner* — Zachary L Kuhfuss
*Assistant Examiner* — Cheng Lin
(74) *Attorney, Agent, or Firm* — WOMBLE BOND DICKINSON (US) LLP

(57) ABSTRACT

Disclosed is a bogie framework of a rail vehicle and a bogie, wherein the bogie framework of the rail vehicle includes a first end beam (01), a second end beam (02) and a box beam disposed between the first end beam (01) and the second end beam (02). The box beam includes a primary gearbox (1) and a secondary gearbox (2), and the primary gearbox (1) is used for connecting a traction motor and the secondary gearbox (2). The secondary gearbox (2) is disposed between
(Continued)

the primary gearbox (1) and the first end beam (01), as well as between the primary gearbox (1) and the second end beam (02).

16 Claims, 4 Drawing Sheets

(51) Int. Cl.

| | |
|---|---|
| ***B61C 9/38*** | (2006.01) |
| ***B61F 5/52*** | (2006.01) |
| *B61C 9/52* | (2006.01) |

(56) References Cited

FOREIGN PATENT DOCUMENTS

| | | | | |
|---|---|---|---|---|
| CN | 105416331 | A | | 3/2016 |
| CN | 105774834 | A | * | 7/2016 |
| CN | 106541823 | A | | 3/2017 |
| CN | 106864465 | A | | 6/2017 |
| CN | 107128321 | A | * | 9/2017 |
| CN | 207089305 | U | | 3/2018 |
| CN | 108657215 | A | | 10/2018 |
| CN | 109664898 | A | | 4/2019 |
| CN | 110155087 | A | | 8/2019 |
| CN | 110155110 | A | | 8/2019 |
| CN | 110667391 | A | | 1/2020 |
| CN | 210062992 | U | | 2/2020 |
| DE | 10208526 | A1 | | 9/2003 |

OTHER PUBLICATIONS

The International Search Report of the International Searching Authority for PCT Application No. PCT/CN2020/090828 mailed Aug. 13, 2020, 3 pages.

Search Report of the Chinese priority application No. 201910462853X mailed May 30, 2019, 5 pages.

The Second Office Action for Chinese Application No. 201910462853.X mailed May 8, 2020, 13 pages, [English Translation].

Supplementary Search Report of the Chinese priority application No. 201910462853X mailed Jul. 13, 2020, 3 pages.

The Third Office Action for Chinese Application No. 201910462853.X mailed Jul. 21, 2020, 14 pages, [English Translation].

Written Opinion of the International Searching Authority for PCT Application No. PCT/CN/2020/090828, mailed Aug. 13, 2020, 9 pages.

* cited by examiner

BOGIE FRAMEWORK OF RAIL VEHICLE AND BOGIE

CROSS-REFERENCE TO RELATED APPLICATION APPLICATIONS

The present application is a U.S. National Phase Application under 35 U.S.C. § 371 of International Application No. PCT/CN2020/090828, filed 18 May 2020, entitled BOGIE FRAMEWORK OF RAIL VEHICLE AND BOGIE, which claims priority to Chinese Patent Application No. 201910462853X, filed on May 30, 2019, entitled "BOGIE FRAMEWORK OF RAILWAY VEHICLE AND BOGIE", which is hereby was incorporated by reference in its entirety.

FIELD OF TECHNOLOGY

The present application relates to the technical field of rail vehicles, and in particular to a bogie framework of rail vehicle and a bogie.

BACKGROUND

As important parts of rail vehicles, bogie frames directly determine the power performance and safety performance of the rail vehicles. For the bogie frames nowadays, a motor mounting seat and a gearbox boom seat are formed thereon, and a motor and a gearbox are mounted through the motor mounting seat and the gearbox boom seat respectively. One problem of this type of bogie frame is that the motor mounting seat and the gearbox boom seat need to be additionally provided, which results in low efficiency of disassembly and assembly of the bogie. Moreover, after the motor and the gearbox are mounted on the bogie frame, the height of the undercarriage will be excessive, that is, the height of the rail vehicle floor from the ground will be over high, which affects the escape and evacuation of passengers and reduce the safety of operation. In addition, the excessive height of the rail vehicle floor from the ground will also weaken the driving safety and reduce the rolling resistance of the rail vehicle.

BRIEF SUMMARY

The present application is intended to address at least one of the problems above.

An objective of the present application is to provide a bogie framework of rail vehicle to solve the technical problems of low bogie disassembly and assembly efficiency and excessive height of the rail vehicle floor from the ground.

In order to achieve this objective, the present application provides a bogie framework of rail vehicle, including a first end beam, a second end beam, and a box beam disposed between the first end beam and the second end beam; the box beam comprises a primary gearbox and a secondary gearbox; the primary gearbox is configured to connect a traction motor and the secondary gearbox, and transmit power from the traction motor to the secondary gearbox; the secondary gearbox is disposed between the primary gearbox and the first end beam, as well as between the primary gearbox and the second end beam.

In an embodiment, the box beam further includes a motor box of the traction motor, the motor box is symmetrically disposed on both sides of the primary gearbox, and the motor box, the primary gearbox, and the secondary gearbox are connected to form a cross-shaped beam.

In an embodiment, the primary gearbox includes a primary box body, the primary box body includes a top plate, a bottom plate, a first side plate connecting the top plate and the bottom plate, and a first end plate connecting the first side plate, and both the first side plate and the first end plate are provided with first avoidance holes; the motor box includes a top support plate, a bottom support plate, and a second end plate connecting the top support plate and the bottom support plate, and the second end plate is provided with a second avoidance hole; the second end plate is disposed corresponding to the first end plate; the secondary gearbox includes a secondary box body, and the secondary box body includes a second connecting flange corresponding to the first side plate.

In an embodiment, the secondary box body and the first end beam, as well as the secondary box body and the second end beam are both connected by plug joints.

In an embodiment, both the first side plate and the first end plate extend toward an outer side of the top plate, and a mounting platform for air spring is formed between the top plate, the first side plate and the first end plate.

In an embodiment, a mounting table is provided on a side of the top plate proximal to the mounting platform, and the mounting table is configured to connect with the secondary gearbox.

In an embodiment, the secondary box body is divided into a left box body and a right box body by a vertical longitudinal section, and the left box body and the right box body are each formed with a first connecting flange along an opening.

In an embodiment, the secondary box body is provided with a support seat extending outwards, and the secondary gearbox further includes a first wheel axle and a second wheel axle configured to connect traveling wheels on different sides of a wheelset. Both the first wheel axle and the second wheel axle extend from the support seat to an outer side of the secondary box body, and an end of the first wheel axle and an end of the second wheel axle both located inside the secondary box body are connected by a differential.

In an embodiment, the motor box further includes a second side plate connecting the top support plate, the bottom support plate, and the second end plate; and the second side plate is provided with a wire bracket and a through hole of a cooling pipeline.

The present application also provides a bogie including the above-mentioned bogie framework.

The bogie framework and the bogie of the present application has at least the following advantages: the bogie framework of the present application integrates the gearbox on the bogie framework, thereby improving the efficiency of disassembly and assembly of the bogie. In addition, because the gearbox does not need to be additionally provided on the basis of the bogie framework, the height of the rail vehicle floor from the ground can be reduced, and the rolling resistance of the rail vehicle can be enhanced. Further, the integrated design of the gearbox and the bogie framework and the built-in gear drive are conducive to reducing the height of the bogie, meeting the shield requirements of suburban elevated railways, urban tunnels and A-type subway tunnels, and greatly reducing project costs.

Further, for the bogie framework of the present application, because the motor box is integrated on the bogie framework, the efficiency of disassembly and assembly of the bogie is further improved, the height of the rail vehicle floor from the ground is reduced, and the rolling resistance of the rail vehicle is improved.

BRIEF DESCRIPTION OF THE DRAWINGS

In order to more clearly illustrate the technical solutions in the embodiments of the present application or the prior art, drawings needed in the descriptions of the embodiments or the prior art will be briefly introduced below. Obviously, the drawings in the following description only show some of the embodiments of the present application, and other drawings can be obtained according to these drawings without any creative effort for those skilled in the art.

REFERENCE NUMERALS

Figure 1:
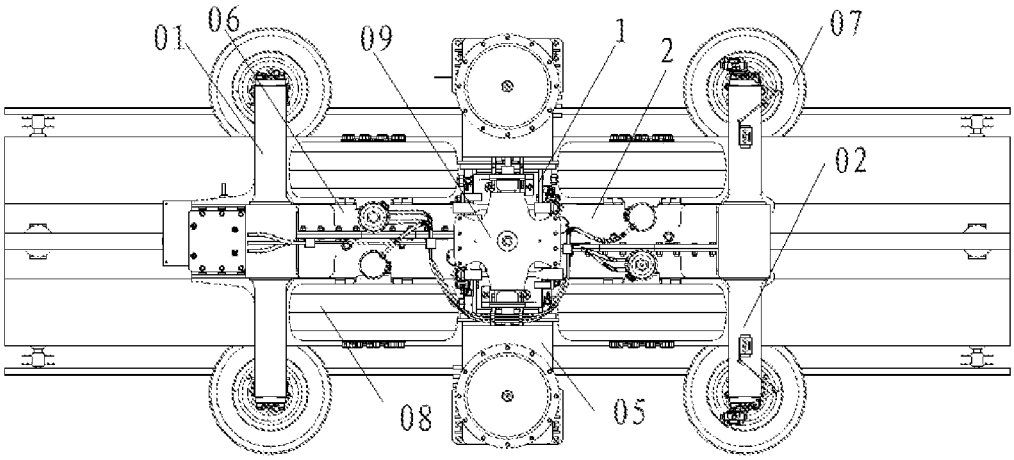
FIG. 1 is a schematic structural top view of a bogie according to an embodiment of the present application.

1. primary gearbox; 2. secondary gearbox; 3. top plate; 4. bottom plate; 5. first side plate; 6. first end plate; 7. first connecting flange; 8. second connecting flange; 9. mounting platform; 10. plug joint; 11. first input shaft; 12. mounting table; 01. first end beam; 02. second end beam; 03. traction motor body; 04. coupling; 05. motor box; 06. axle box; 07. guide wheel; 08. travelling wheel; 09. central traction mounting seat; 010. track beam; 011. limit mounting plate; 301. top support plate; 302. bottom support plate; 303. second side plate.

DETAILED DESCRIPTION

In order to provide clearer understanding of the objectives, features and advantages of the present disclosure, the present application will be further described in detail below in conjunction with the accompanying drawings and specific embodiments. It should be noted that the embodiments of the present application and the features in the embodiments can be combined with each other when there is no conflict.

In the description of the present application, it should be noted that unless otherwise specified, the orientations or positional relationships indicated by terms such as "center", "longitudinal", "lateral", "upper", "lower", "front", "rear", "left", "right", "vertical", "horizontal", "top", "bottom", "inside", "outside" are based on the orientation or positional relationship shown in the drawings, and are merely for the convenience of describing the present application and simplifying the description, rather than indicating or implying that the device or component referred to must have a particular orientation, is constructed and operated in a particular orientation, and thus should not be construed as limiting the present application. Moreover, the terms "first", "second", "third", and the like are used for descriptive purposes only and should not be construed as indicating or implying relative importance.

In the description of the present application, it should be noted that unless explicitly specified and defined otherwise, the terms "connected with" and "connected to" shall be understood broadly, for example, it may be either fixedly connected or detachably connected, or may be integrated; it may be mechanically connected, or electrically connected; it may be directly connected, or indirectly connected through an intermediate medium. The specific meanings of the terms above in the present application can be understood by those of ordinary skill in the art in accordance with specific conditions.

Figure 2:
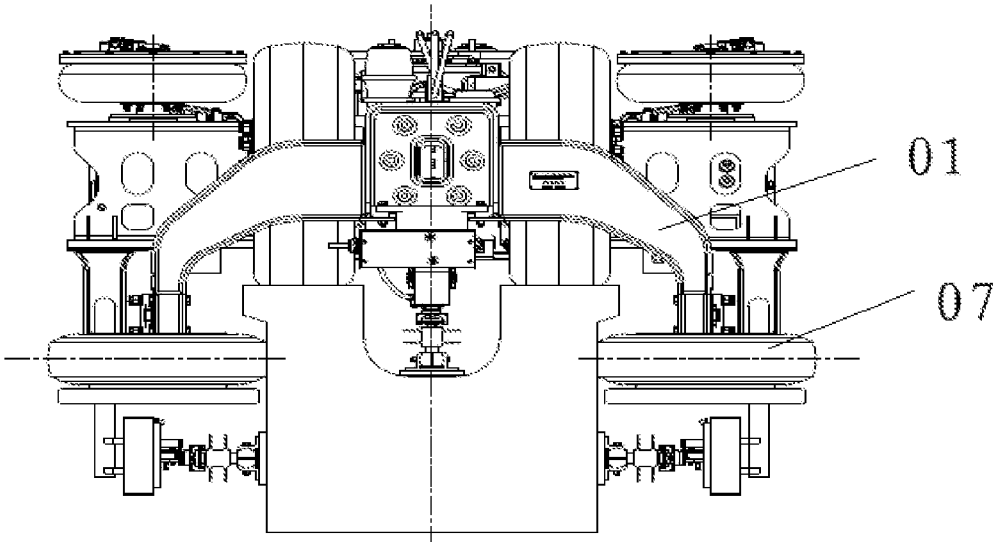
FIG. 2 is a schematic structural side view of a bogie according to an embodiment of the present application.
Figure 3:
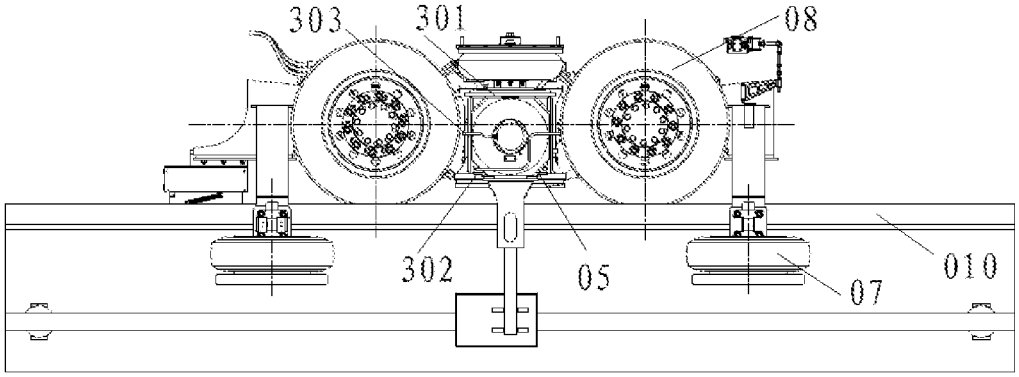
FIG. 3 is a schematic structural front view of a bogie according to an embodiment of the present application.

As shown in FIGS. 1 to 3, an embodiment provides a bogie framework of rail vehicle, including a first end beam 01, a second end beam 02, and a box beam disposed between the first end beam 01 and the second end beam 02; the box beam includes a primary gearbox 1 and a secondary gearbox 2, and the primary gearbox 1 is configured to connect a traction motor and the secondary gearbox 2, and transmit power from the traction motor to the secondary gearbox 2; the secondary gearbox 2 is disposed between the primary gearbox 1 and the first end beam 01, as well as between the primary gearbox 1 and the second end beam 02.

For this kind of bogie framework, as the gearbox is integrated on the bogie framework, the efficiency of disassembly and assembly of the bogie is improved. In addition, because the gearbox does not need to be additionally provided on the basis of the bogie framework, the height of the rail vehicle floor from the ground can be reduced, and the rolling resistance of the rail vehicle can be enhanced. Further, the integrated design of the gearbox and the bogie framework and the built-in gear drive are conducive to reducing the height of the bogie, meeting the shield requirements of suburban elevated railways, urban tunnels and A-type subway tunnels, and greatly reducing project costs.

In addition, the use of this type of bogie framework may reduce the overall weight of the bogie, thereby reducing the wear of tires of the travelling wheel 08 and saving operating costs.

It is worth mentioning that the embodiment illustrates the bogie framework of rail vehicle mentioned above only in the case of a monorail vehicle. Without loss of generality, the bogie framework of rail vehicle mentioned above can be applied to dual rail vehicles in addition to monorail vehicles.

Taking the double-axle straddling monorail vehicle which may have good running stability, smoothness, comfortable ride, and large passenger capacity as an example, due to its floor structure, the section of a track beam 010 is as high as 1.5 meters, customers therefore wish to optimize the structure of the double-axle straddling monorail transportation system, so as to reduce the floor height of straddling monorail vehicles, facilitate passengers to escape and evacuate, and improve operational safety.

When the double-axle straddle monorail vehicle adopts the above-mentioned bogie framework of rail vehicle, the cross section height of the track beam 010 will be greatly reduced. Specifically, the cross section height of the track beam 010 may be reduced by about 600 mm, and thus the level of passenger escape and evacuation is increased without changing the floor height of the vehicle. In addition, combined with the optimization of the vehicle body structure, the total height of passing section of the vehicle and track can be reduced up to about 700 mm, which in turn reduces the cross section height of the tunnels and saves the project cost.

In an embodiment, the box beam further includes a motor box 05 of the traction motor, the motor box 05 is symmetrically or nearly symmetrically disposed on both sides of the primary gearbox 1, and the motor box 05, the primary gearbox 1, and the secondary gearbox 2 are connected to form a cross-shaped beam; and the "cross-shaped" beam is just a visual analogy, and it is not strictly required that the motor box 05 and the primary gearbox 1 must be collinear, or the primary gearbox 1 and the secondary gearbox 2 must be perpendicular.

Furthermore, the cross-shaped beam and the first end beam 01 and the second end beam 02 may form a double-H-shaped bogie framework. In this case, the primary gearbox 1 and the motor box arranged on both sides of the primary gearbox 1 are connected to form a box beam.

For this kind of bogie framework, because the motor box is integrated on the bogie framework, the efficiency of disassembly and assembly of the bogie is further improved, the height of the rail vehicle floor from the ground is reduced, and the rolling resistance of the rail vehicle is improved.

The motor box 05 is configured to mount the traction motor body which serves as a power drive unit. Along the power transmission direction of the bogie, the traction motor body is sequentially connected to the primary gearbox 1, the secondary gearbox 2, and the wheel axle. Specifically, an output shaft of the traction motor body is connected to a first input shaft 11 of the primary gearbox 1, an output shaft of the primary gearbox 1 is connected to a second input shaft of the secondary gearbox 2, and an output shaft of the secondary gearbox 2 is connected to the wheel axle. Furthermore, a transmission unit and a power unit are both integrated on the bogie framework to simplify the structure of the bogie and reduce the weight of the bogie.

In combination with the structure of the bogie framework, it can be seen that the transmission direction has changed between the primary gearbox 1 and the secondary gearbox 2. The power transmission direction in the primary gearbox 1 is along the transverse direction, and the power transmission direction of the secondary gearbox 2 is along the longitudinal direction.

For the double-H-shaped bogie framework, it has a good load-bearing capacity, and the gearbox and the motor box 05 do not need to occupy additional space under the vehicle.

A central traction mounting seat 09 is fixed on the primary gearbox 1 to facilitate the mounting of a traditional Z-shaped traction device or a traction device of other structural forms. The central traction mounting seat 09 and the primary gearbox 1 are two independent structures, which can in turn facilitate the processing and forming of the central traction mounting seat 09 and the primary gearbox 1 respectively. Moreover, once the structure of the central traction mounting seat 09 is fatigued and damaged, the central traction mounting seat 09 can also be easily repaired or replaced.

According to one of the embodiments of the present application, the central traction mounting seat 09 is provided with a transverse stop seat and a vertical stop seat, and in this case, the integrated design of various stops and the central traction mounting seat 09 is provided, which can in turn facilitate the structural maintenance of the bogie framework.

According to one of the embodiments of the present application, the distance between the box beam and the first end beam 01 is equal to the distance between the box beam and the second end beam 02, thereby ensuring the structural symmetry of the double-H-shaped bogie framework.

According to one of the embodiments of the present application, both the first end beam 01 and the second end beam 02 are U-shaped beams with an opening facing downward, as shown in FIG. 2. Specifically, the U-shaped beam includes cantilever beams and a connecting beam located between the cantilever beams on both sides. The structure of the first end beam 01 and the second end beam 02 may facilitate the installation of the guide wheel 07.

As it should be, the bogie framework of rail vehicle may also include an axle box 06 in addition to the components mentioned above. The axle box 06 is fixed on the gearbox and is arranged longitudinally between the motor box 05 and the first end beam 01, as well as between the motor box 05 and the second end beam 02.

A mounting groove is formed on the top of the gearbox, and the axle box 06 is fixed in the mounting groove. Compared with the traditional axle box located at the bottom of the bogie framework, not only can the space at the bottom of the bogie framework be saved, but the axle box 06 can also be used as a component of the bogie framework to strengthen the structural strength of the bogie framework.

Referring to FIG. 1, the axle box 06 is symmetrically arranged on both sides of the box beam to facilitate the symmetrical installation of the wheels.

According to one of the embodiments of the present application, each pair of travelling wheels 08 includes a first travelling wheel and a second travelling wheel. The first travelling wheel is connected to the first wheel axle, and the second travelling wheel is connected to the second wheel axle. The gearbox is connected between the first and second wheel axles through a differential.

By providing a differential, the speeds of the first travelling wheel and the second travelling wheel of each wheelset may be different, thereby improving the driving safety in the turning process or under other conditions.

Figure 4:
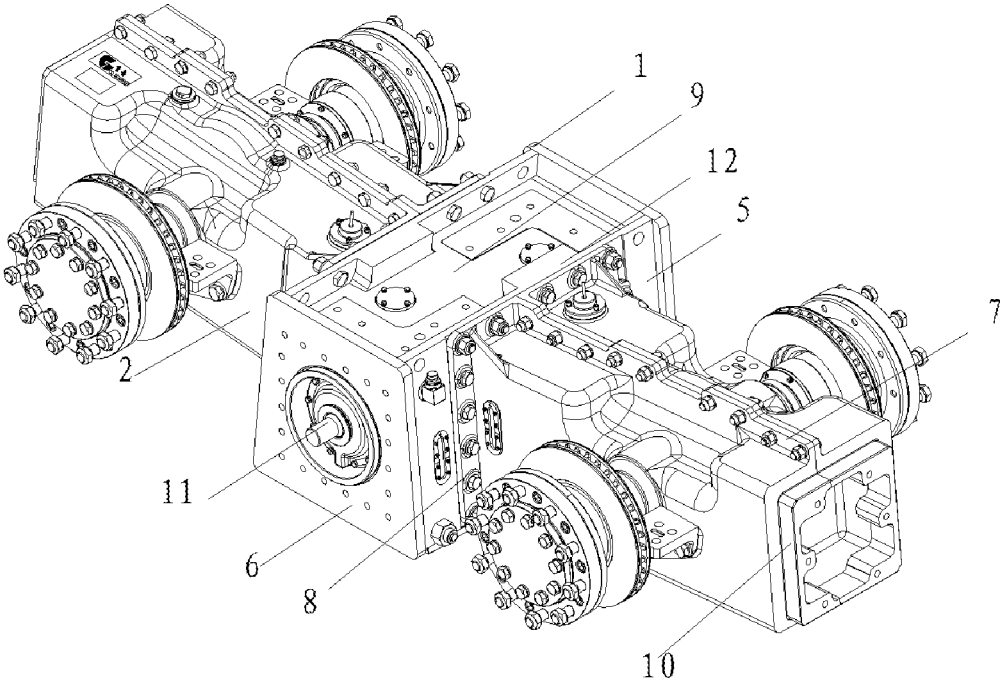
FIG. 4 is a schematic three-dimensional structural diagram showing a rail vehicle bogie with a gearbox according to an embodiment of the present application.
Figure 5:
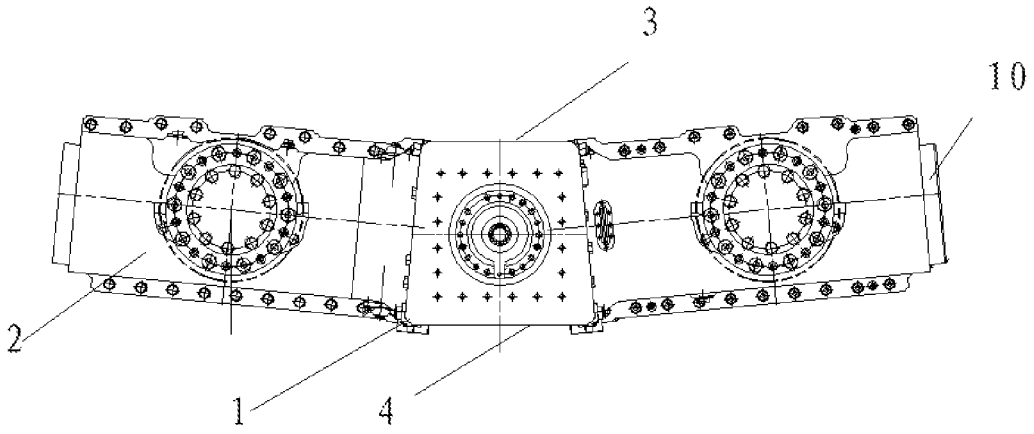
FIG. 5 is a schematic structural side view showing a rail vehicle bogie with a gearbox according to an embodiment of the present application.

Referring to FIGS. 4 and 5, along the longitudinal direction of the rail vehicle, the secondary gearbox 2 is gradually inclined upward toward the direction away from the primary gearbox 1. That is, in FIGS. 4 and 5, a frame bearing beam formed by the gearbox is recessed downward at the position of the primary gearbox 1. Because the primary gearbox 1 carries an air spring above it, the vehicle body of the rail vehicle is carried above the air spring, and the travelling wheel has a constant wheel diameter. By making a recess at the primary gearbox 1, the overall height of the rail vehicle can be reduced, thereby improving the running stability of the rail vehicle and ensuring safety during escape. That is, when other components of the rail vehicle are of inconvenient specifications, the overall height of the rail vehicle can be reduced by designing the gearbox of the rail vehicle into a form that the primary gearbox 1 is relatively concave.

The secondary gearbox 2 includes a first secondary gearbox and a second secondary gearbox arranged on both sides of the primary gearbox 1. The first secondary gearbox is configured to transmit power from the primary gearbox 1 to the front wheelset of the rail vehicle, and the second secondary gearbox is configured to transmit power from the primary gearbox 1 to the rear wheelset of the rail vehicle.

When the first secondary gearbox and the second secondary gearbox have the same structure, it is possible but not necessary to symmetrically arrange the first secondary gearbox and the second secondary gearbox on both sides of the primary gearbox 1.

According to one of the embodiments of the present application, the primary gearbox 1 includes a primary box body, the primary box body includes a top plate 3, a bottom plate 4, a first side plate 5 connecting the top plate 3 and the bottom plate 4, and a first end plate 6 connecting the first side plate 5. By providing the top plate 3, the bearing surface of the primary gearbox 1 can be increased, so that when the primary gearbox 1 is used as a component of the frame bearing beam, the force is more uniform, and the stress concentration on the primary box body can be prevented. The specific structural forms of the top plate 3, the bottom plate 4, the first side plate 5 and the first end plate 6 are not limited, which may be a flat plate structure, a curved plate with a curvature, or a bent plate. Moreover, the primary gearbox 1 has a structure that is not limited by the embodiments here, as long as it can meet the load-bearing requirements.

In order to ensure the power transmission from the traction motor body to the wheelset, both the first side plate 5 and the first end plate 6 of the primary gearbox 1 are provided with first avoidance holes. The first avoidance hole on the first end plate 6 is for enabling the connection between the traction motor body and the gear train inside the primary gearbox 1. Specifically, a first input shaft 11 is provided at the first end plate 6, and the first input shaft 11 is connected to the coupling 04 of the traction motor body. The first avoidance hole on the first side plate 5 is for enabling the connection between the gear train inside the primary gearbox 1 and the gear train inside the secondary gearbox 2.

In FIG. 4, the first side plate 5 of the primary box body refers to the plate structure connected with the secondary gearbox 2, and the first end plate 6 refers to the trapezoidal plate in FIG. 4.

It is worth mentioning that in FIGS. 4 and 5, the first end plate 6 is designed in the form of a trapezoidal plate, which can make the structure of the primary box body more stable, so that the force received by the top plate 3 is transmitted to the bottom plate 4 through the first side plate 5 and the first end plate 6, thereby preventing the top plate 3 from being damaged. In addition, designing the first end plate 6 in the form of a trapezoidal plate can also facilitate the installation of the secondary gearbox 2, so that the secondary gearbox 2 is fixed on the first side plate 5 while the requirement of "along the longitudinal direction of the rail vehicle, the secondary gearbox 2 is gradually inclined upward toward the direction away from the primary gearbox 1" is satisfied.

Further referring to FIG. 4, both the first side plate 5 and the first end plate 6 extend toward an outer side of the top plate 3, and a mounting platform 9 for air spring is formed between the top plate 3, the first side plate 5 and the first end plate 6. The mounting platform 9 is a concave platform formed on the top of the primary gearbox 1, which makes the installation of the air spring reliable and stable.

Figure 6:
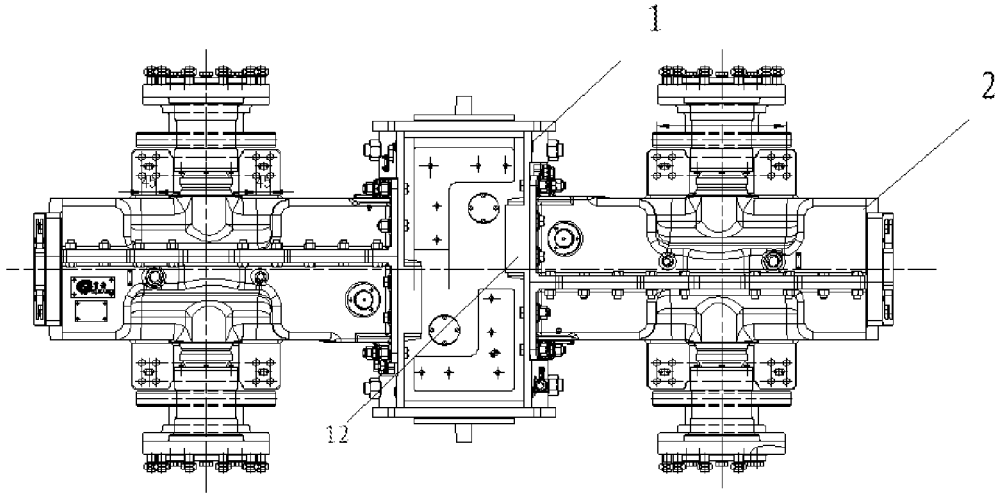
FIG. 6 is a schematic structural top view showing a rail vehicle bogie with a gearbox according to an embodiment of the present application.

Referring to FIGS. 4 and 6, a mounting table 12 is provided on a side of the top plate 3 proximal to the mounting platform 9, and the mounting table 12 is configured to connect with the secondary gearbox 2. For example, the threaded part passes through the secondary gearbox 2 and then penetrates into the mounting table 12 to provide the fixation between the secondary gearbox 2 and the primary gearbox 1. If the mounting table 12 is not provided, the area on the primary gearbox 1 for connecting the secondary gearbox 2 may be a weak link under force of the primary gearbox 1.

Further, referring to FIGS. 4 and 6, the mounting tables 12 corresponding to two first side plates 5 are staggered with each other, so as to meet the distribution requirements of other components.

According to one of the embodiments of the present application, the secondary gearbox 2 includes a secondary box body, which is divided into a left box body and a right box body by a vertical longitudinal section. Separating the secondary box body into the left box body and the right box body from the vertical longitudinal section may facilitate the installation of the internal gear train of the secondary box body. Further, in order to facilitate the installation of the gear train of the secondary gearbox 2, in addition to dividing the secondary box body into multiple parts at the vertical longitudinal section, the secondary box body may also be divided from any other position.

Further, the left box body and the right box body are each formed with a first connecting flange 7 along an opening, thereby facilitating the assembly of the left box body and the right box body. The left box body and the right box body may be tightened by circumferential bolts to meet the needs of quick installation.

According to one of the embodiments of the present application, a second connecting flange 8 is provided on the end surface of the secondary box body proximal to the primary gearbox 1. When the primary box body is connected to the secondary box body, the second connecting flange 8 is attached to the first side plate 5 of the primary box body and fixed with a threaded part, so that the second connecting flange 8 bears the shearing force generated by the vibration between the primary box body and the secondary box body. Further, the second connecting flange 8 increases the force-bearing area between the primary box body and the secondary box body, and at the same time may facilitate the connection between the primary box body and the secondary box body.

Further, a positioning stop may be provided between the primary box body and the secondary box body to enable quick installation between the primary box body and the secondary box body.

In addition, multiple bolt holes may be reserved on the surfaces of the primary box body and the secondary box body to respectively assemble multiple functional components such as traction device (e.g. the central traction mounting seat 09), traveling system, frame mounting seat, traction motor body mounting seat, and brake seat. In addition, two independent transmission systems may be arranged in the primary box body and the secondary box body, and the two transmission systems do not interfere with each other, thereby meeting the requirements of independent transmission for the front wheelset and the rear wheelset.

According to one of the embodiments of the present application, the secondary gearbox 2 protrudes to form a support seat for connecting with the bearing of the wheelset. The support seat may be used to install the bearing and allow the wheel axle to connect the wheelset after passing through the support seat.

Referring again to FIG. 4, an end of the secondary gearbox 2 away from the primary gearbox 1 is formed with a plug joint 10 for connecting with the end beam of the framework. By providing the plug joint 10, the assembly of the bogie framework may be facilitated, and the positioning and connection between the end beam and the gearbox-type frame bearing beam may be enabled.

In order to reduce the weight of the bogie framework, a weight reduction hole is formed at the position of the plug joint 10.

According to one of the embodiments of the present application, the primary box body is processed and welded with steel plate, and has a box-shaped structure. The secondary box body is cast and has a sub-box structure. The sub-box surface is a flange surface of the first connecting flange 7.

The aforementioned gearbox of rail vehicle is classified into a primary gearbox 1 and a secondary gearbox 2, and the primary gearbox 1 and the secondary gearbox 2 are used as the central structure of the bogie to provide installation positions for other functional components of the bogie.

In an embodiment, provided is a bogie of rail vehicle, including the above-mentioned bogie framework of rail vehicle, and further including: a traction motor body 03 in the motor box 05. The traction motor body 03 includes an output shaft; the motor box 05 includes a top support plate 301, a bottom support plate 302, and a second end plate connecting the top support plate 301 and the bottom support plate 302; a second avoidance hole of the output shaft is formed on the second end plate.

The motor box 05 and the traction motor body 03 form the traction motor body of the rail vehicle bogie.

As for the traction motor body of rail vehicle bogie, the motor box 05 is provided outside the traction motor body 03. The top support plate 301 of the motor box 05 may be used to install air springs, the bottom support plate 302 may be used to support the traction motor body 03, and the second end plate meets the connection requirements of the bogie framework, and thus the motor box 05 may be integrated on the bogie framework of rail vehicle, which simplifies the overall structure of the bogie and is conducive to subsequent maintenance and repair. In addition, the bogie provided with the traction motor body of rail vehicle bogie does not need to be separately and additionally provided with a traction motor body mounting seat, thus the preparation is simple, the structural strength is high, and there is no safety hazard during operation, which solves a series of problems caused by the low integration of the rail vehicle bogie.

Further, by integrating the traction motor body and the bogie framework of rail vehicle, it is beneficial to reduce the height of the bogie, meet the shield requirements of suburban elevated railways, urban tunnel and A-type subway tunnel, and greatly reduce project costs. For the rail vehicle equipped with the traction motor body of the rail vehicle bogie, the height of the vehicle floor from the evacuation channel can be reduced, and the escape safety can be improved.

It is worth mentioning that the traction motor body 03 may be protected, since the motor box 05 is provided outside the traction motor body 03, to prevent the traction motor body 03 from being affected by the external environment and prematurely scrapped.

It is worth mentioning that the second end plate may be provided at both ends of the traction motor body 03 or only at one end of the traction motor body 03. For the traction motor body 03, the two ends are defined along the axial direction of the output shaft thereof. Taking FIG. 1 as an example, the output shaft of the traction motor body 03 (not shown in FIG. 1) has an axial direction as the longitudinal direction of FIG. 1, and then the two ends of the traction motor body 03 are the upper and lower ends in FIG. 1. When only one end of the traction motor body 03 is provided with the second end plate, namely the motor box 05 has an open design, the opening position may facilitate the disassembly and assembly of the traction motor body 03.

Further, the motor box 05 further includes a second side plate 303 connecting the top support plate 301, the bottom support plate 302 and the second end plate. Therefore, the top support plate 301, the bottom support plate 302, the second end plate and the second side plate 303 may protect the traction motor body 03 from multiple sides.

A wire bracket is provided on the second side plate 303. Therefore, various sensors of the traction motor body of the rail vehicle bogie may be wired through the wire bracket. By arranging the wire bracket on the second side plate 303, interference between the wires and other structures of the bogie can be prevented.

In the same way, a through hole of a cooling pipeline is formed on the second side plate 303 to facilitate the installation of the cooling pipeline. The cooling pipeline may be a cooling water pipe or a cooling air pipe. When the cooling water pipe is used as the cooling pipeline, the cooling water pipe may be connected to a water tank at the bottom of the vehicle body. Alternatively, it is also possible to additionally provide a cooling water tank connected to the above-mentioned cooling water pipe. By providing a through hole on the second side plate 303 and installing a cooling pipeline based on the through hole, the heat dissipation of the traction motor body 03 can be enhanced, and heat can be prevented from accumulating in the motor box 05.

Figure 7:
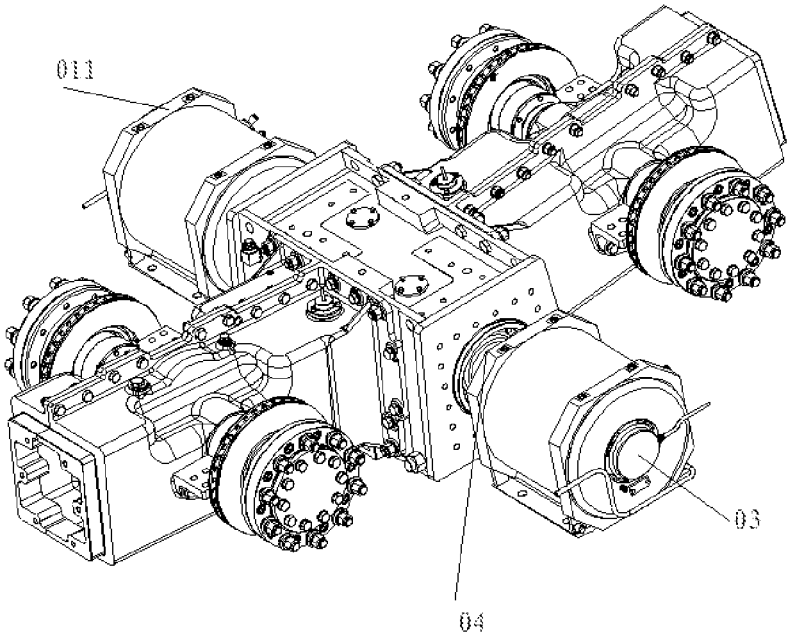
FIG. 7 is a schematic diagram showing the connection relationship between a traction motor body and a gearbox according to an embodiment of the present application.

Referring to FIG. 7, the traction motor body 03 also includes a limit mounting plate 011. The limit mounting plate 011 may be installed between the top support plate 301 and the bottom support plate 302, to prevent the traction motor body 03 from shaking in the motor box 05, and ensure the reliability of the installation of the traction motor body 03.

In FIG. 7, the limit mounting plate 011 is octagonal or approximately octagonal, and correspondingly, the motor box 05 is a rectangular box. In this case, the limit mounting plate 011 may be in contact with the top support plate 301, the bottom support plate 302, and the second side plate 303 of the motor box 05 at the same time, or maintain a slight gap with the top support plate 301, the bottom support plate 302 and the second side plate 303, thereby limiting the movement of the traction motor body 03 in each direction. Moreover, since the octagonal limit mounting plate 011 can be regarded as a rectangular plate with four chamfers, the limit mounting plate 011 can easily enter the motor box 05 without scratching the inner wall of the motor box 05.

Further, a screw hole is formed on the limit mounting plate 011, so that a threaded connection piece passes through the motor box 05 and then enters the screw hole of the limit mounting plate 011 to fix the traction motor body 03 in the motor box 05. The threaded connection piece mentioned here may be either a bolt or a screw.

The implementations above are only used to illustrate the present application, but not to limit the present application. Although the present application has been described in detail with reference to the embodiments, those skilled in the art should understand that various combinations, modifications, or equivalent substitutions of the technical solutions of the present application do not depart from the scope of the technical solutions of the present application, and should all be covered within the scope of the claims of the present application.

What is claimed is:

1. A bogie framework of rail vehicle, comprising a first end beam, a second end beam, and a box beam disposed between the first end beam and the second end beam; the box beam comprises a primary gearbox and a secondary gearbox; the primary gearbox is configured to connect a traction motor and the secondary gearbox, and transmit power from the traction motor to the secondary gearbox; and the secondary gearbox is disposed between the primary gearbox and the first end beam, as well as between the primary gearbox and the second end beam;

the box beam further comprises a motor box of the traction motor, the motor box is symmetrically disposed on both sides of the primary gearbox, and the motor box, the primary gearbox, and the secondary gearbox are connected to form a cross-shaped beam, a primary gearbox box body of the primary gearbox has a trapezoidal section in a longitudinal direction of the rail vehicles, and the secondary gearboxes are gradually inclined upward toward the direction away from the primary gearbox along the longitudinal direction of the rail vehicle.

2. The bogie framework of rail vehicle of claim 1, wherein the primary gearbox comprises a primary box body, the primary box body comprises a top plate, a bottom plate, a first side plate connecting the top plate and the bottom plate, and a first end plate connecting the first side plate, and both the first side plate and the first end plate are provided with first avoidance holes; the motor box comprises a top support plate, a bottom support plate, and a second end plate connecting the top support plate and the bottom support plate, and the second end plate is provided with a second avoidance hole; the second end plate is disposed corresponding to the first end plate; the secondary gearbox comprises a secondary box body, and the secondary box body comprises a second connecting flange corresponding to the first side plate.

3. The bogie framework of rail vehicle of claim 2, wherein the secondary box body and the first end beam, as well as the secondary box body and the second end beam are both connected by plug joints.

4. The bogie framework of rail vehicle of claim 2, wherein both the first side plate and the first end plate extend toward an outer side of the top plate, and a mounting platform for air spring is formed among the top plate, the first side plate and the first end plate.

5. The bogie framework of rail vehicle of claim 4, wherein a mounting table is provided on a side of the top plate proximal to the mounting platform, and the mounting table is configured to connect with the secondary gearbox.

6. The bogie framework of rail vehicle of claim 2, wherein the secondary box body is divided into a left box body and a right box body by a vertical longitudinal section, and the left box body and the right box body are each formed with a first connecting flange along an opening.

7. The bogie framework of rail vehicle of claim 2, wherein the secondary box body is provided with a support seat extending outwards, the secondary gearbox further comprises a first wheel axle and a second wheel axle configured to connect traveling wheels on different sides of a wheelset, both the first wheel axle and the second wheel axle extend from the support seat to an outer side of the secondary box body, and an end of the first wheel axle and an end of the second wheel axle both located inside the secondary box body are connected by a differential.

8. The bogie framework of rail vehicle of claim 2, wherein the motor box further comprises a second side plate connecting the top support plate, the bottom support plate and the second end plate, and the second side plate is provided with a wire bracket and a through hole of a cooling pipeline.

9. A bogie, comprising a bogie framework of rail vehicle, comprising a first end beam, a second end beam, and a box beam disposed between the first end beam and the second end beam; the box beam comprises a primary gearbox and a secondary gearbox; the primary gearbox is configured to connect a traction motor and the secondary gearbox, and transmit power from the traction motor to the secondary gearbox; and the secondary gearbox is disposed between the primary gearbox and the first end beam, as well as between the primary gearbox and the second end beam;

the box beam further comprises a motor box of the traction motor, the motor box is symmetrically disposed on both sides of the primary gearbox, and the motor box, the primary gearbox, and the secondary gearbox are connected to form a cross-shaped beam, a primary gearbox box body of the primary gearbox has a trapezoidal section in a longitudinal direction of the rail vehicles, and the secondary gearboxes are gradually inclined upward toward the direction away from the primary gearbox along the longitudinal direction of the rail vehicle.

10. The bogie of claim 9, wherein the primary gearbox comprises a primary box body, the primary box body comprises a top plate, a bottom plate, a first side plate connecting the top plate and the bottom plate, and a first end plate connecting the first side plate, and both the first side plate and the first end plate are provided with first avoidance holes; the motor box comprises a top support plate, a bottom support plate, and a second end plate connecting the top support plate and the bottom support plate, and the second end plate is provided with a second avoidance hole; the second end plate is disposed corresponding to the first end plate; the secondary gearbox comprises a secondary box body, and the secondary box body comprises a second connecting flange corresponding to the first side plate.

11. The bogie of claim 10, wherein the secondary box body and the first end beam, as well as the secondary box body and the second end beam are both connected by plug joints.

12. The bogie of claim 10, wherein both the first side plate and the first end plate extend toward an outer side of the top plate, and a mounting platform for air spring is formed among the top plate, the first side plate and the first end plate.

13. The bogie of claim 12, wherein a mounting table is provided on a side of the top plate proximal to the mounting platform, and the mounting table is configured to connect with the secondary gearbox.

14. The bogie of claim 10, wherein the secondary box body is divided into a left box body and a right box body by a vertical longitudinal section, and the left box body and the right box body are each formed with a first connecting flange along an opening.

15. The bogie of claim 10, wherein the secondary box body is provided with a support seat extending outwards, the secondary gearbox further comprises a first wheel axle and a second wheel axle configured to connect traveling wheels on different sides of a wheelset, both the first wheel axle and the second wheel axle extend from the support seat to an outer side of the secondary box body, and an end of the first wheel axle and an end of the second wheel axle both located inside the secondary box body are connected by a differential.

16. The bogie of claim 10, wherein the motor box further comprises a second side plate connecting the top support plate, the bottom support plate and the second end plate, and the second side plate is provided with a wire bracket and a through hole of a cooling pipeline.

* * * * *